US008333285B2

(12) United States Patent
Kiehnau et al.

(10) Patent No.: US 8,333,285 B2
(45) Date of Patent: Dec. 18, 2012

(54) TRACK FOR A DISPLAY CASE

(75) Inventors: Brenda Kiehnau, Cedarburg, WI (US); Raul Romeiro, West Chester, OH (US); Greg Gerard, Cincinnati, OH (US)

(73) Assignee: Innomark Communications, Fairfield, OH (US)

( * ) Notice: Subject to any disclaimer, the term of this patent is extended or adjusted under 35 U.S.C. 154(b) by 1877 days.

(21) Appl. No.: 11/257,447

(22) Filed: Oct. 24, 2005

(65) Prior Publication Data

US 2006/0207950 A1 Sep. 21, 2006

Related U.S. Application Data

(60) Provisional application No. 60/663,332, filed on Mar. 18, 2005.

(51) Int. Cl.
*A47B 73/00* (2006.01)
*A47G 29/087* (2006.01)

(52) U.S. Cl. ..... 211/75; 211/119.003

(58) Field of Classification Search ..... 211/59.2, 211/119.003, 85.18, 74, 88.01, 86.01, 72, 211/75, 45, 73; 312/45, 72
See application file for complete search history.

(56) References Cited

U.S. PATENT DOCUMENTS

| | | | | |
|---|---|---|---|---|
| 1,994,200 | A * | 3/1935 | Parker | 211/88.01 |
| 2,639,040 | A | 5/1953 | Tapley | |
| 2,733,113 | A * | 1/1956 | Humbargar | 312/249.7 |
| 3,776,388 | A * | 12/1973 | Mattheis | 211/119.003 |
| 3,904,041 | A * | 9/1975 | Medgebow | 211/72 |
| 3,949,880 | A * | 4/1976 | Fortunato | 211/119.003 |
| 4,496,037 | A | 1/1985 | Spamer | |
| 4,962,860 | A * | 10/1990 | Lehmann | 211/88.01 |
| 5,090,577 | A | 2/1992 | Lehmann | |
| 5,333,745 | A * | 8/1994 | Lehmann | 211/88.01 |
| 5,341,945 | A * | 8/1994 | Gibson | 211/184 |
| 5,370,064 | A * | 12/1994 | Sgabellone | 108/162 |
| 6,779,670 | B2 * | 8/2004 | Primiano et al. | 211/74 |
| 6,811,044 | B2 * | 11/2004 | Walker | 211/119.003 |
| 6,962,260 | B2 * | 11/2005 | Jay et al. | 211/59.2 |
| 7,004,334 | B2 * | 2/2006 | Walsh et al. | 211/88.01 |
| 7,080,744 | B2 * | 7/2006 | Robertson | 211/75 |
| 2003/0080075 | A1 * | 5/2003 | Primiano et al. | 211/59.2 |
| 2003/0222037 | A1 * | 12/2003 | Belokin et al. | 211/75 |
| 2005/0139560 | A1 * | 6/2005 | Whiteside et al. | 211/119.003 |

FOREIGN PATENT DOCUMENTS

FR 2 706 268 A1 12/1994

* cited by examiner

*Primary Examiner* — Jennifer E. Novosad
(74) *Attorney, Agent, or Firm* — Dinsmore & Shohl LLP

(57) ABSTRACT

A track for a display case. The track can be mounted to a front edge of a shelf to allow prominent display of food or beverage containers, as well as promoting more complete use of the space within the display case. While applicable to all beverage display cases, the track of the present invention is particularly beneficial in retail or related commercial display cases, as it places products in a prominent visual location without obscuring a user's ability to identify or retrieve a container disposed on a shelf behind the track. In one form, it allows for substantially horizontal alignment of containers, to minimize the likelihood of obscuring products situated behind the track.

20 Claims, 10 Drawing Sheets

TRACK FOR A DISPLAY CASE

This application claims the benefit of U.S. Provisional Application No. 60/663,332 filed Mar. 18, 2005.

BACKGROUND OF THE INVENTION

The present invention relates generally to shelving augmentation, and more particularly to a forward-mountable track for retail and related commercial use within a display case.

Refrigerated display cases are commonly used in retail settings to provide for convenient dispensing of food, beverages and related products. In a common form, the display cases employ numerous generally horizontal or gravity-fed shelves onto which the product is placed while awaiting purchase. These shelves are configured to maximize the number of cans, bottles or related product containers that can be seen in the limited amount of space typically available in the display case. Furthermore, the display cases are typically equipped with glass or related optically transparent hinged doors and optional (generally fluorescent) lighting to make it easier to visually identify a familiar or desired product. The makers and distributors of such product are often jockeying for premium shelf space, examples of which include eye level and up-front (closest to the consumer) locations. Such competition also extends to room-temperature display shelving, including gondola-style shelving.

A relatively recent attempt to more fully exploit the precious display case "real estate" in the extremely competitive beverage display industry involves the use of tray-like tracks that mount directly onto the door such that they occupy the void between a plane defined by the front edge of the rows of shelving and a plane defined by the rearward-facing part of the door. In one form, suction cups are used to secure the trays to the generally smooth glass surface. Such devices prominently display the product containers placed therein; however, their use tends to obscure products that are placed on the shelves behind them, especially when beverage containers placed within them are oriented in their normal (vertical) position. In addition, unless the suction cups are properly secured, the weight of the containers could cause tray separation. Similarly, the use of excessive speed in opening the doors could cause container toppling. In either event, ensuing spillage, breakage or related mess is likely to occur. In addition, the trays can not be adjusted to accommodate display cases of varying widths, thereby necessitating that a vendor, supplier or retailer inconveniently keep numerous such trays on hand. Furthermore, trays (especially the wire frame variant) do not readily accept advertising or promotional material for display or easy replacement, either of which is subject to relatively frequent change.

What is needed is a display track that can be unobtrusively mounted inside a conventional display case to promote easy viewing of containers placed therein such that the container does not become obscured by other products placed in the display case. What is further needed is a display track that can be mounted in a secure and stationary way such that containers placed therein are not susceptible to becoming dislodged. What is further needed is a display track that can be adjusted to promote an optimized fit of the track within the display case.

BRIEF SUMMARY OF THE INVENTION

These needs are met by the present invention, where according to one aspect, a display track can be mounted directly onto existing display case shelving. The track is attachable to a shelf in such a position that a product placed within the track does not substantially obscure a product placed on the shelf. As used in the present context, the term "substantially" refers to features that, while in theory would be expected to exhibit exact correspondence or behavior, may in practice embody something slightly less than exact. As such, the term denotes the degree by which a quantitative value, measurement or other related representation may vary from a stated reference without resulting in a change in the basic function of the subject matter at issue. Similarly, a product the access of or view of which is unhampered, unimpeded or unobscured is one that can be readily identified or grasped by a consumer or related user without having to move or otherwise disturb products placed between the user and the intended product. In this context, a row of products placed in the display track of the present invention in an orientation dictated by the display track would tend to not obscure, hamper or impede a consumer's ability to identify or grasp products placed on a shelf behind the row of products placed in the display track, while a row of products placed in a display track of the prior art, which typically involves an upright orientation of the displayed product, would tend to obscure, hamper or impede a consumer's ability to identify or grasp products situated on the shelf behind the track.

The display track of the present invention is made up of a shelf-engaging portion defining a substantially rigid structure and a product cradle portion rigidly coupled to the shelf-engaging portion. The product cradle portion may include at least one line of weakness formed therein to define a corresponding frangible portion. It will be understood that the line of weakness facilitates separation of a portion of the length of the track through an appropriate snapping action, but is otherwise strong enough to carry a load normally associated with a product container placed in that portion.

Optionally, the product cradle portion could be formed as an extruded piece. While such a form might not include the lines of weakness discussed above, it could allow the display track to be formed into various lengths, depending on the need. In another option, the track further comprises a label-mounting portion disposed on a forward-facing surface of the product cradle portion. In one configuration, the label-mounting portion includes numerous inwardly-pointing detents disposed on opposing ends of the forward-facing surface. The detents act as holders for a printed sheet, card or label so that a user can slide the sheet between the detents. The vertical dimension of the sheet is such that it is slightly greater than the distance between opposing detents such that once the sheet is inserted, it will not come loose. The structure is similar in effect to the tabs placed on the inside of a compact disc jewel case, where the tabs retain the information booklet that accompanies the compact disc. The product cradle portion preferably defines a substantially elongate direction along the track. In addition, the product cradle portion defines a substantially horizontal arcuate trough region. This is especially well-suited to cylindrical containers that can be displayed horizontally.

Preferably, the line of weakness is formed across the substantially elongate direction. In a more particular form, the frangible portion formed by the line (or lines) of weakness is approximately six inches in length. In a particular option, the shelf-engaging portion, label-mounting portion and product cradle portion make up a unitary structure to define a one-piece construction, and is particularly well-suited to being made from a plastic material. In another option, a clip can be used to secure the shelf-engaging portion to the shelf. The clip is sued to provide secure, frictional fit, and may be made up of numerous components (including an bottom clip, top clip and lock clip). In a preferred form the various clip components can be made from bent or similarly-formed sheet metal, all held together by a fastener (such as a nut and bolt), or by a resilient snap-fit connection. In other forms, the clip components can be made from plastics or related polymers. Tight tolerances between the thickness of the bottom clip (which has a vertically upturned segment) and a corresponding slot-shaped cutout formed in the shelf-engaging portion of the track promote a secure fit.

In one form, the display track is made from a plastic-based material, and can be sized to clip directly onto the front edge of a wire shelf. In a particular form, the display track allows for the horizontal placement of beverage containers therein such that even when full, the display track does not obscure other products placed on the shelves behind. Moreover, the length of the track is adjustable to accommodate any shelf width. For example, the display track may be made up of several frangible sections that can be broken off to accommodate a particular display case width. The arcuate shape of the trough may also be formed with different-dimensioned radii, thereby enabling containers (such as cylindrical beverage containers) to securely fit into the trough.

According to another aspect of the invention, a shelf for display case is disclosed. The shelf includes a substantially tray-like structure configured to hold a plurality of product containers in a substantially upright orientation, and a substantially trough-like structure configured to hold a plurality of product containers in a substantially horizontal orientation forward of the substantially tray-like structure such that the trough-like structure is closer to the consumer than the tray-like structure. The trough-like structure includes at least one line of weakness to define a frangible portion. In the present context, a product or container is considered to be in an upright orientation when the container is stood on its end. Thus, liquid containers, such as bottles and cans, would be considered placed upright when stood on their axial ends. Stated another way, if the labeling on the container that pertains to the product inside is readable in a substantially horizontal, left-to-right format, the container is by convention situated in an upright orientation. Contrarily, a product or container is considered to be in a horizontal orientation when the container is laid on its side, or where the elongate dimension is placed substantially horizontal.

Optionally, the shelf includes a label-mounting portion disposed on a forward-facing surface of the trough-like structure. This label-mounting portion may be configured similar to that of the previous aspect of the invention. The trough-like structure may be attached to the tray-like structure with a clip, or may be integrally formed with the tray-like structure.

According to yet another aspect of the invention, a method of displaying a product for sale is disclosed. The method includes arranging product containers on a display shelf such that the product containers are in a substantially upright orientation; mounting a substantially trough-like structure to a substantially forward end of the display shelf, the trough-like structure defining a substantially horizontal container-receiving region that includes at least one line of weakness therein to define a corresponding frangible portion thereby; and placing a plurality of product containers in the trough-like structure such that a view of or access to product containers arranged on the shelf is substantially unimpeded. Optionally, mounting the trough-like structure comprises placing it in front of the shelf in such a way as to minimize the vertical distance the trough-like structure extends above and below the shelf. The shelf and trough-like structure can be disposed inside a cooled display case, or in an ambient (room-temperature) environment, such as a retail aisle. The method may further include breaking off at least a portion of the trough-like structure along the at least one line of weakness prior to mounting the structure to the display shelf.

According to still another aspect of the invention, a method of displaying a product in front of a shelf in a retail environment is disclosed. The method includes arranging a display track to comprise a substantially horizontal container-receiving region. The method additionally includes ascertaining a width of the shelf and a length of the display track. The method additionally includes securing the track to the shelf with at least one clip, and placing a product in the track. Examples of products that can be placed in the track include, but are not limited to, bottles, cans, tubes of semi-solid materials (such as cookie dough), cartons or the like. Optionally, the clip is made up of numerous disparate components, such as a fastener, top clip, bottom clip and locking clip. In a particular embodiment, placing a product comprises placing the product in a substantially horizontal orientation such that the longest dimension of the product (or its container) is placed substantially along a horizontal axis, thereby minimizing the likelihood of obscuring the view of or access to products placed on the shelf behind the track. As with previous aspects, the track may include at least one line of weakness formed in the horizontal container-receiving region to define a corresponding frangible portion that can be broken off as needed in order to fit within a particular environment. For example, in situations where the length of the display track is greater than the width of the shelf, one or more portions of the track that extend beyond the shelf can be broken off along the line (or lines) of weakness.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1A:
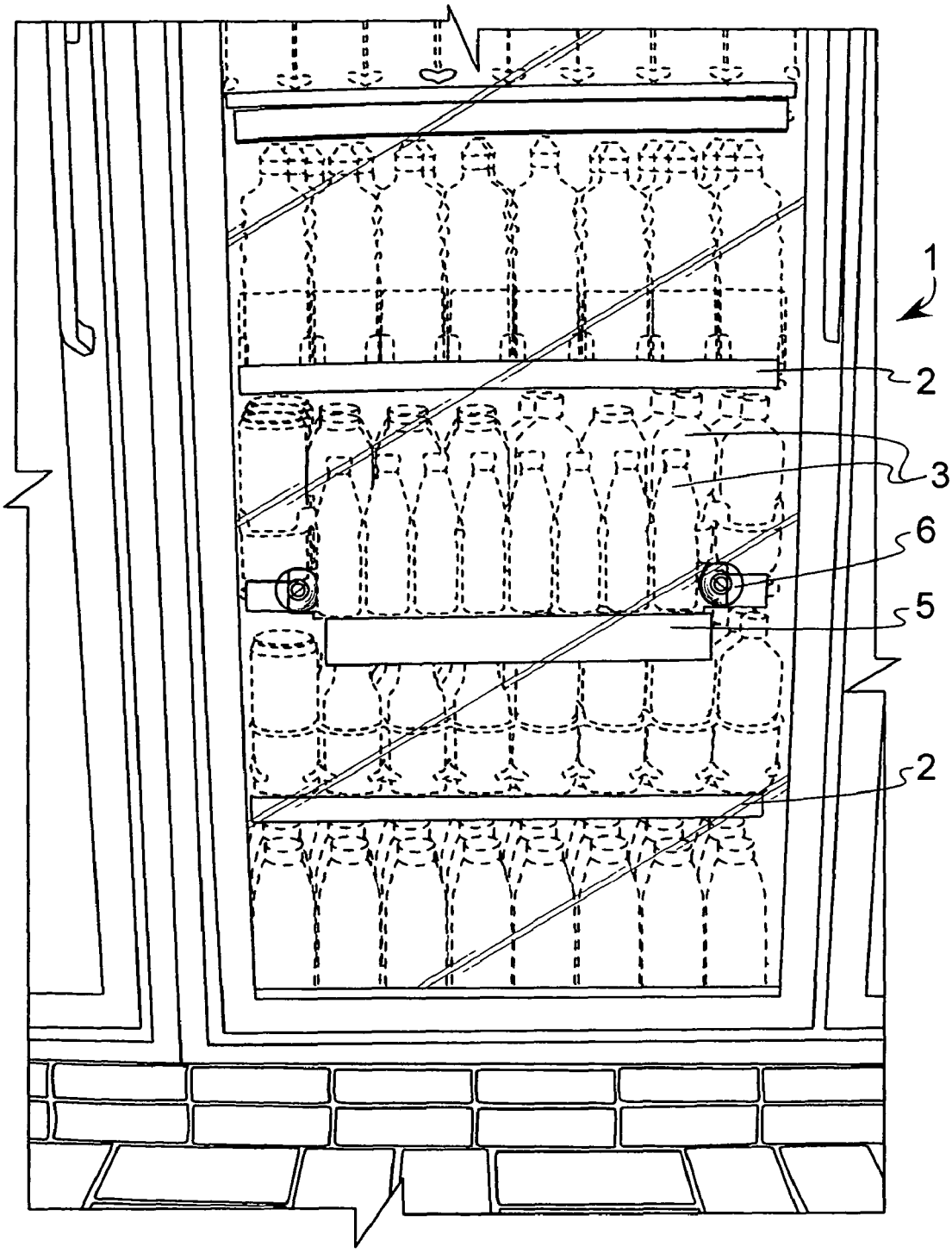
FIG. 1A (PRIOR ART)
FIG. 1A is an elevation view of a portion of a display case with a door-mounted display track according to the prior art, where products placed behind the track are significantly obscured.
Figure 1B:
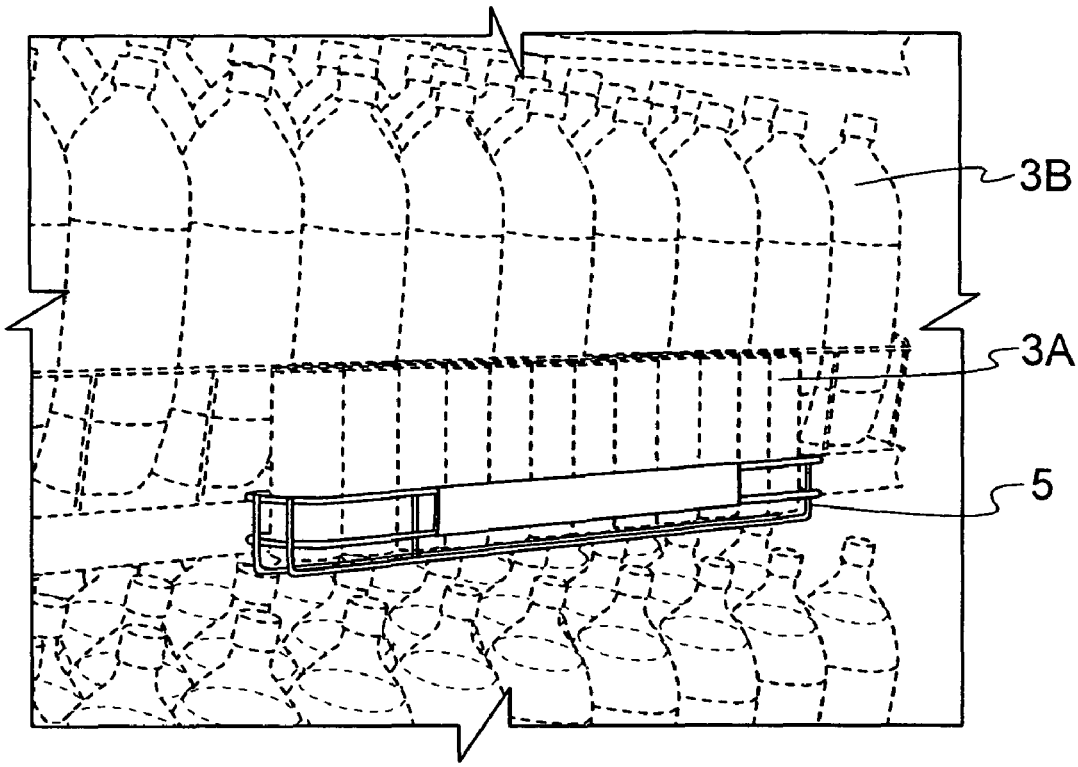
FIG. 1B (PRIOR ART)
FIG. 1B is an elevation view of a shelf-mounted display track according to the prior art.

Referring to FIGS. 1A and 1B, a conventional display case 1 with a display track 5 according to the prior art is shown. The case 1 can hold numerous shelves 2 onto which a plurality of containers (generally referred to as 3 and subsets thereof) can be placed. Although the containers 3 shown in display 1 are in the form of beverage bottles, it will be appreciated that other container configurations, including cans, cartons or jugs may also be stored and displayed, and that other such containers may be of different shape and size to those presently shown. In one popular form, the shelves 2 define a wire frame construction comprising longitudinal members 2A and crossbar members 2B (both shown in detail in FIGS. 4A, 4C and 4E). The front of the shelves 2 may be covered with advertisements, product cost or the like. Referring with particularity to FIG. 1A, display track 5 is mounted directly to door 4, where suction cups 6 are used to keep the former secured to the latter. Referring with particularity to FIG. 1B, display track 5 can be mounted to shelf 2 such as by bent hanger members or twisted wire (neither of which are shown).

In either event, it is common to include fluorescent lights (not shown) behind the door frame of display case 1; in such configurations, additional front-to-back space between the inward-facing portion of the door and the product-holding shelves 2 is formed, thereby allowing the interference-free addition of display track 5. Nevertheless, first containers 3A placed in display track 5 tend to at least partially obscure second containers 3B that are situated on one of the shelves 2, regardless of whether the door-mounted tray of FIG. 1A or the shelf-mounted tray of FIG. 1B is employed. This is undesirable, as the products on the shelf 2 are not displayed as prominently as the retailer would like. In addition, fixed tray lengths mean that retailers or other users of display case 1 are forced to use incompatible tray sizes, resulting in less than optimum display benefit.

Referring next to FIGS. 2A through 2D and 3, a display track 10 according to an embodiment of the present invention is shown. The display track 10 includes a product cradle portion (also referred to as a trough or a cradle) 15 for accepting one or more first containers 3A and a shelf-engaging portion 20 for connection of the display track 10 to a conventional shelf 2. The trough of cradle 15 defines an arcuate region that can readily accommodate cylindrical devices, such as beverage containers. Cradle 15 includes a facade 30 on its forward facing surface to allow attachment of advertisements, product prices or related indicia. Mounting hardware, in the form of clip 25, can be provided for attachment of shelf-engaging portion 20 to crossbar members 2B of shelf 2, and includes a lock clip 25A, top clip 25B and bottom clip 25C that can be fastened to the shelf 2 by bolt 26 and cooperative lock nut 27, all as shown with particularity in FIGS. 2B and 3. The components making up clip 25 can be made of any sturdy (preferably non-corroding) material, including plastic or metal, while at least the lock clip 25A and bottom clip 25C could be made from rigid metal wire or the like. A slot-shaped cutout segment 20A extends the entirety of the elongate (longitudinal) dimension of display track 10, and is sized to engage an upturned portion of bottom clip 25C. As will be discussed in more detail below, cradle 15 may be made up of numerous smaller segments, or may include periodic lines of weakness 19 (only one of which is shown) that define one or more frangible portions along its longitudinal dimension, in either case to allow formation of a display track 10 of various desired lengths. In addition to longitudinal members 2A and crossbar members 2B, shelf 2 includes a conventional retainer 2*c* to deter tipping of second containers 3B. The placement of display track 10 is such that visual and physical access to containers 3B placed on shelf 2 is not hampered by first containers 3A that are situated in cradle 15.

Figure 2A:
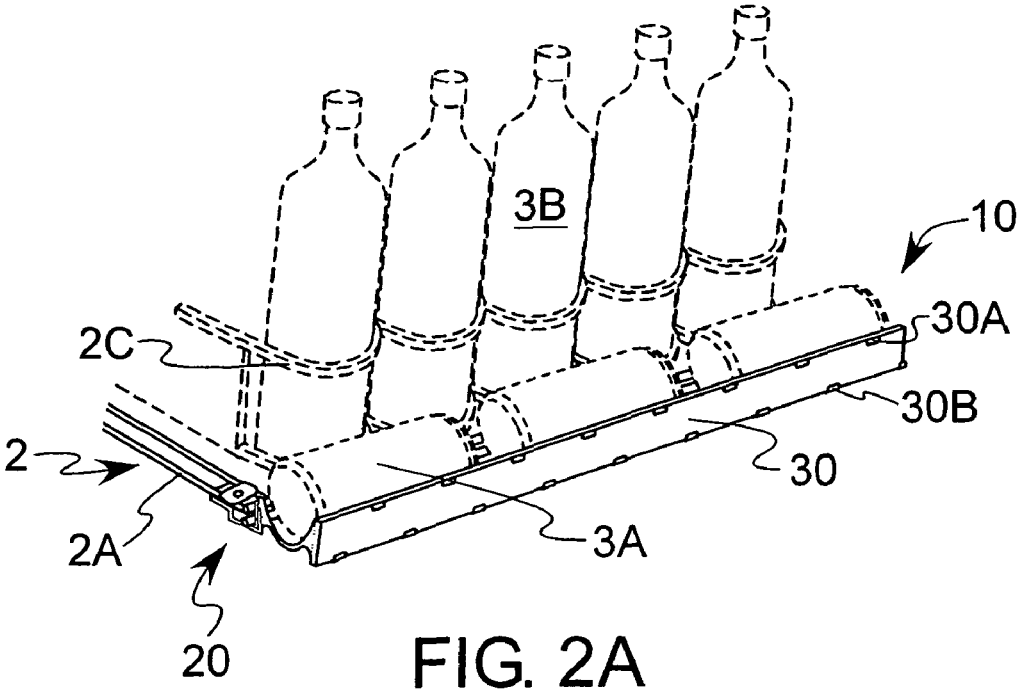
FIG. 2A is a perspective view of a display track according to an embodiment of the present invention connected to a display case shelf.
Figure 2B:
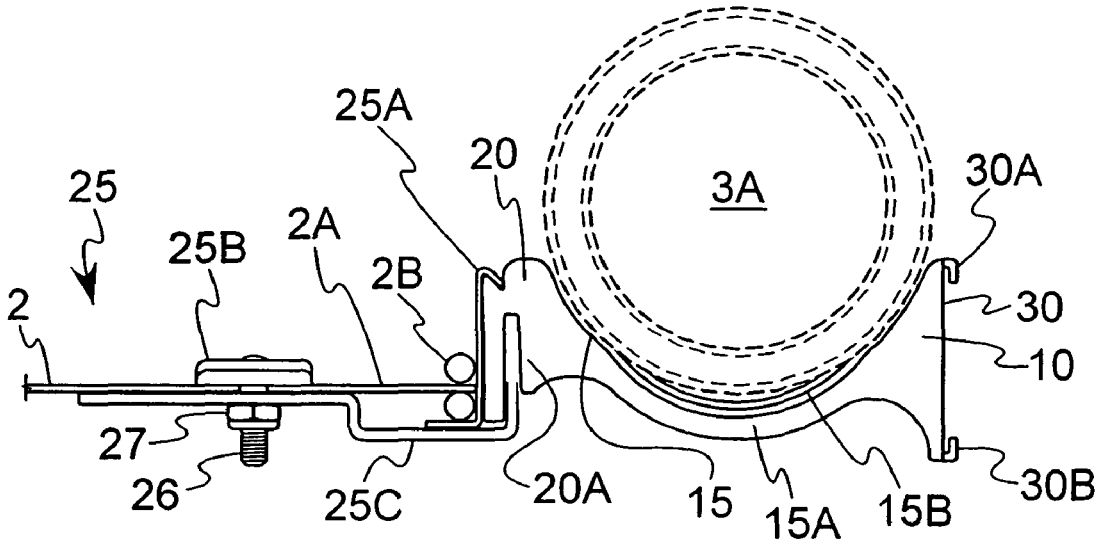
FIG. 2B is a side elevation view showing attachment of the display track of FIG. 2A to the display case shelf.
Figure 3:
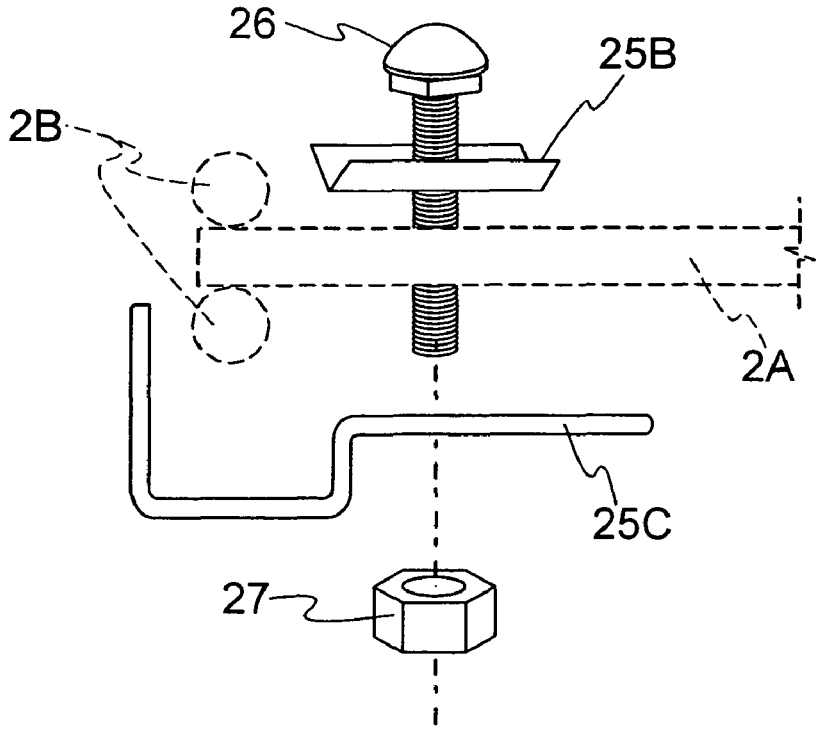
FIG. 3 shows the placement of attachment hardware relative to a display case shelf.
Figure 2C:
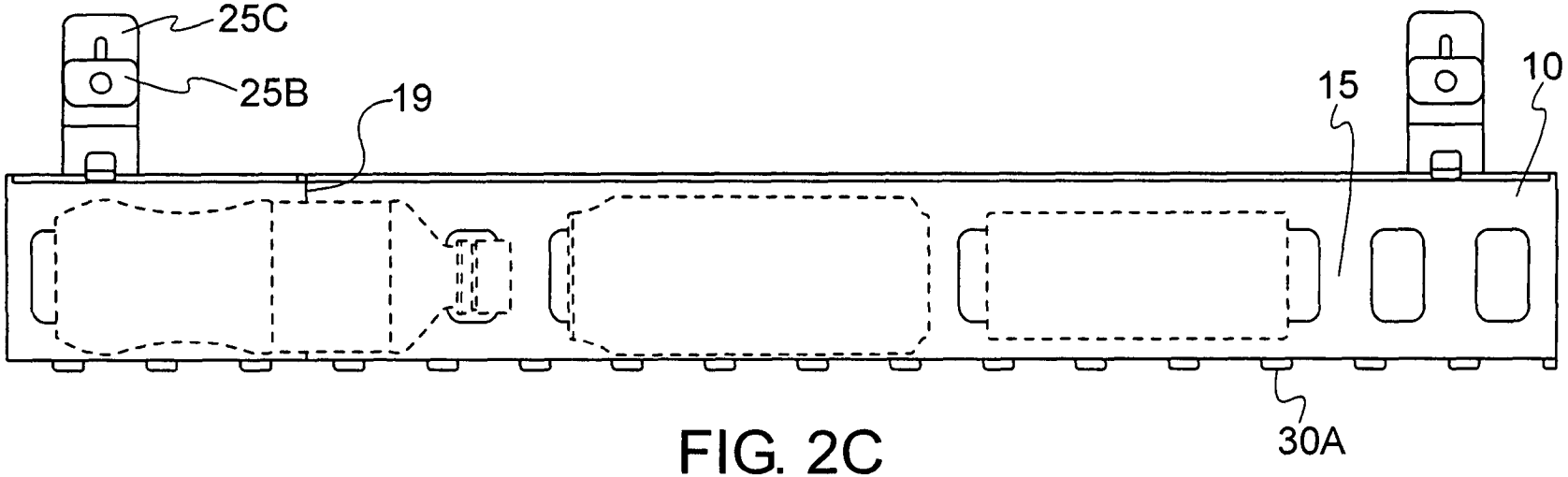
FIG. 2C is a plan view of the display track of FIG. 2A.
Figure 2D:
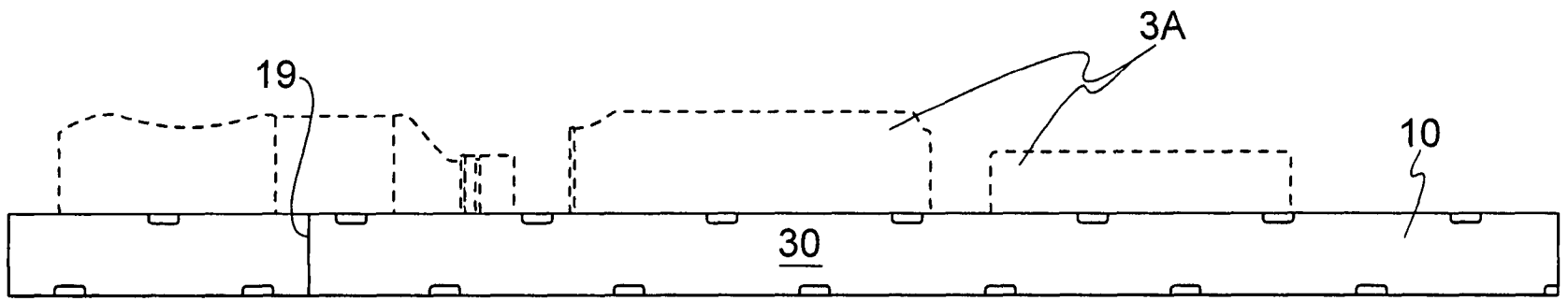
FIG. 2D is a front elevation view of the display track of FIG. 2A.

Referring with particularity to FIG. 2B, the arcuate region of trough 15 is molded with various radii 15A, 15B to accommodate various product circumferences within the same trough 15. Examples of the various sizes of cylindrical containers that can fit into the differing-sized radii 15A, 15B of trough 15 can be seen in FIG. 2C. In addition, the angled end of lock clip 25A forms a complementary fit with a groove formed in the upper rearward-facing portion of trough 15 to promote secure connection between them. Referring with particularity to FIG. 3 in conjunction with FIG. 2B, the clip 25 is sized to provide a secure friction fit against the front edge of shelf 2. The nature of the fit (augmented by the weight of the containers 3A disposed therein) ensures that the display track 10 remains securely mounted. Bolt 26 preferably includes a square-shaped downward protrusion such that once placed in a corresponding square hole in the top clip 25B (shown in FIG. 6C), the two will not rotate relative to each other. Referring with particularity to FIGS. 2A and 2D, facade 30 includes inwardly-pointing detents 30A, 30B to help hold a placard or related sheet containing printed indicia including price strips, advertisements or the like. Preferably, a series of detents 30A, 30B are inwardly-pointing and arranged on the top and bottom edges of facade 30, either directly across from each other or staggered, to face detents disposed on the opposing edge. This allows a user to slide a card, sheet or related label configured to bear printed indicia between the detents such that it will remain in place by the overhanging detent portion. The resilient nature of the material (for example, plastic) of detent 30A, 30B facilitates insertion onto or removal from facade 30 of sheets or placards or related indicia-bearing signage. Referring with particularity to FIG. 2C, slots 17 formed in cradle 15 allow refrigerated air from display case 1 to flow through display track 10 to enable improved convective cooling of containers 3A, 3B and the products within.

In one form, the display track 10 can be made from a plastic material. Such a material would make the track display 10 particularly amenable to breaking off one or more segments along lines of weakness 19 to adjust the longitudinal dimension to fit within the space allotted in the display case 1. In another configuration, the display track could be made from a more robust material (such as stainless steel or other food-grade metal). Such a configuration would be especially valuable in connecting to non-cooled shelves, such as those found in the aisles of a grocery store, where the threat of contact with a grocery cart or shopper could damage a less hefty piece. In a particular metal form, the display track can be made from a metal wire to define a frame-like structure, where various clip components could also be made from wire. It will be appreciated by those skilled in the art that other forms of the display track fall within the scope of this invention. This is especially true in situations where the display track 10 is made from a plastic-based material. For example, the cutout segment 20A of shelf-engaging portion 20 of display track 10 can be shaped for example as an arcuate clip (not shown) and sized to form a snap-fit onto wire shelf crossbar members 2B. In addition, clip 25 may include an arcuate connector that can snap-fit onto crossbar member 2B of shelf 2. In another embodiment, the display track 10 can form part of a shelf 2 such that the two can be sold, constructed and used as a single unit. In one such configuration, the display track 10 can be integrally formed with the shelf 2, while in another, it can be attachable to the shelf 2 in a manner similar to that discussed below in conjunction with FIGS. 6A though 6I, where the tray-like structure of the shelf 2 is used to display in a substantially vertical (i.e., upright) orientation beverage (or related product) second containers 3, while the trough-like structure of the display track 10 is used to display first containers 3A in a substantially horizontal (i.e., sideways) orientation.

Figure 4A:
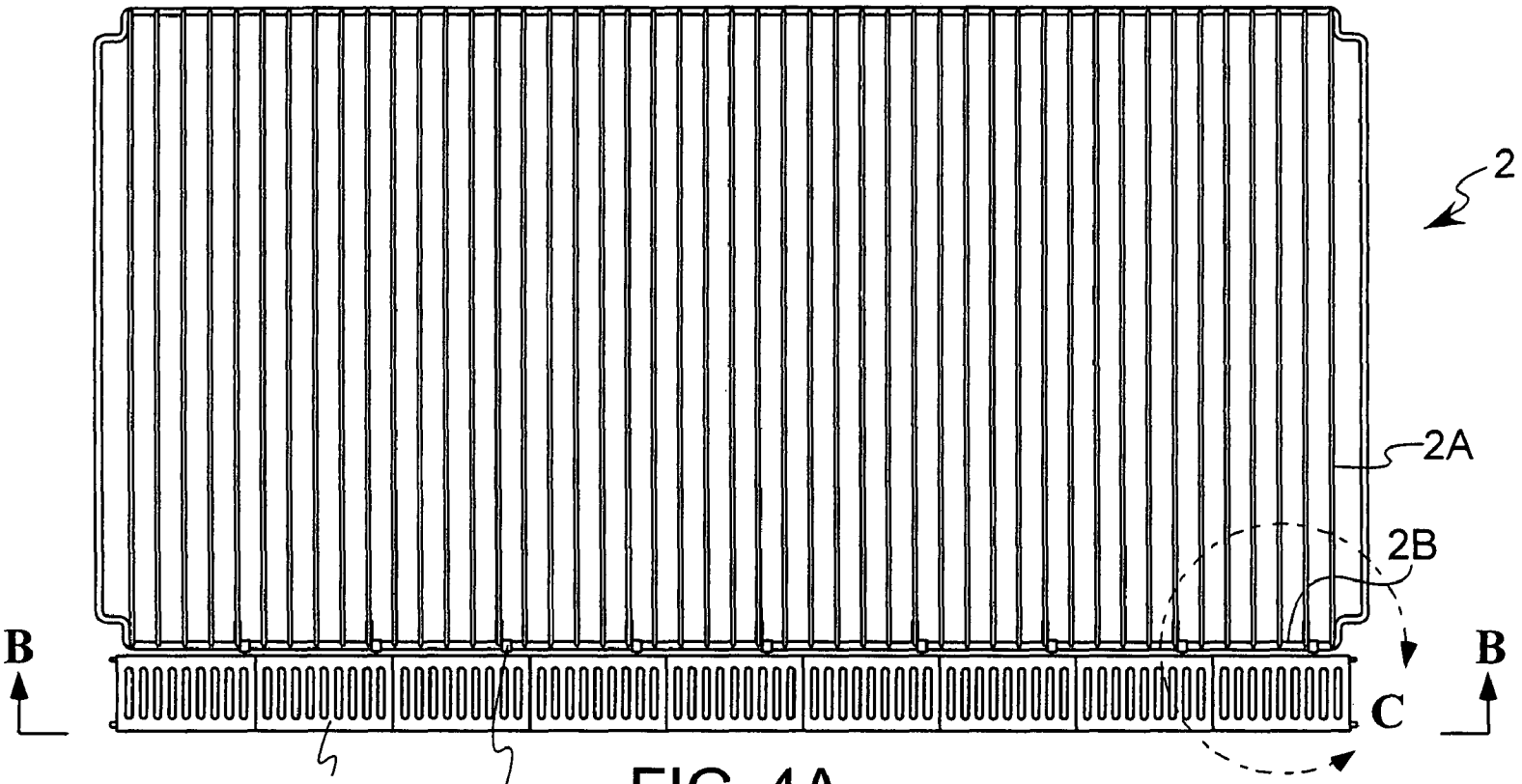
FIG. 4A is a plan view of an alternate embodiment of a display track, shown mounted to a display case shelf.
Figure 4B:
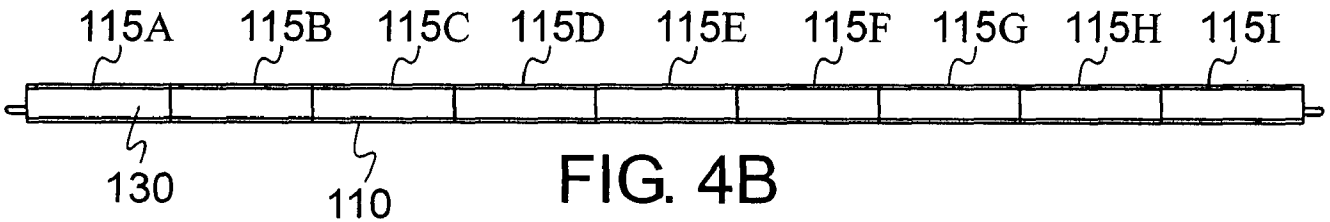
FIG. 4B is a front edge view of the alternate embodiment display track taken along lines B-B of FIG. 4A.
Figure 4C:
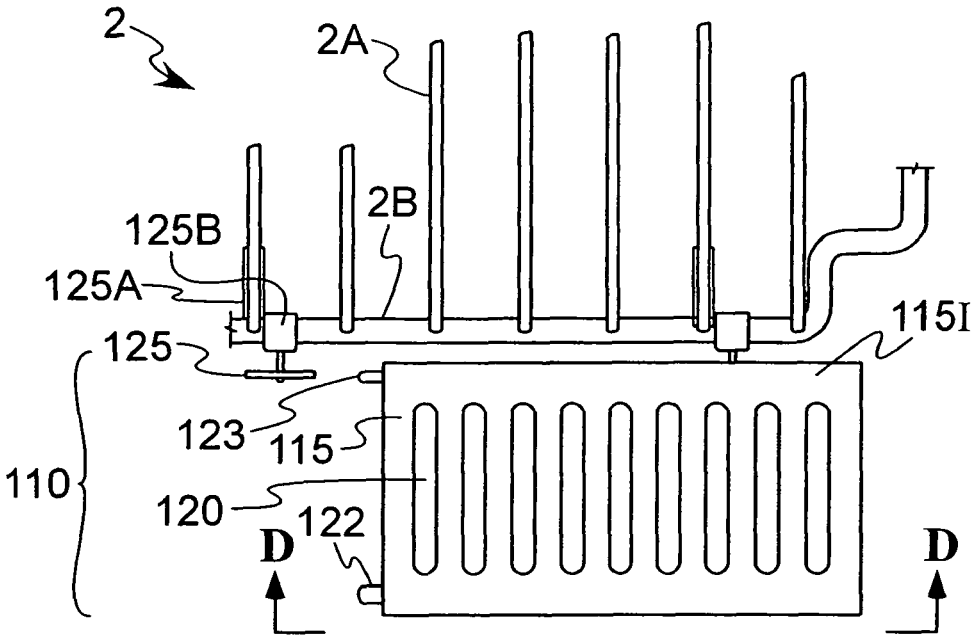
FIG. 4C is a plan detail view of a single segment of the alternate embodiment display track and a corresponding portion of the shelf to which it is attached, taken along circle C of FIG. 4A.
Figure 4D:
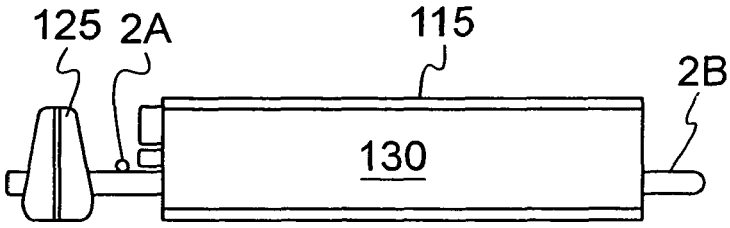
FIG. 4D is an elevation view of the alternate embodiment display track taken along lines D-D of FIG. 4C.
Figure 4F:
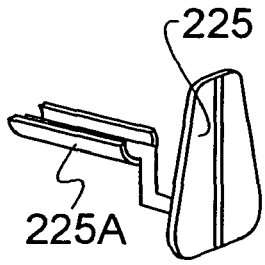
FIG. 4F is a perspective view of another alternate embodiment display track of FIG. 4A, showing connection to the longitudinal member of the display shelf.
Figure 4E:
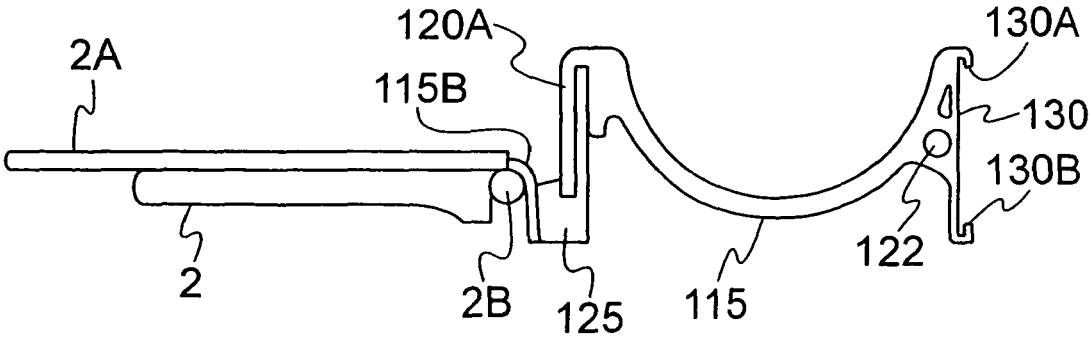
FIG. 4E is a side elevation view of the alternate embodiment display track of FIG. 4A, showing connection to the crossbar member of the display shelf.

Other connection approaches can also be used. In one example (not shown), the display track could form an forward-facing integral extension to the shelf, thereby eliminating the need for a separate set of clips or related attachment devices. It will be appreciated that in this configuration, the separate clip 25 and corresponding display track 10 depicted in FIG. 2B would be integrally formed with one another to define a unitary (i.e., one-piece) structure that could be attached to a shelf 2 with fasteners, or by a resilient snap-fit connection. In a particular form, the trough 15 and clip 25 would be of unitary construction. In another example, referring next to FIGS. 4A through 4F, details pertaining to the connection of a display track 110 according to alternate embodiments of the present invention are shown. In it, clips 125 are used to secure the display track 110 to shelf 2. Referring with particularity to FIGS. 4A and 4B, top and front elevation views respectively indicate placement of display track 110 on the front edge of shelf 2 with numerous clips 125, as well as modular construction of display track 110 made possible by connecting numerous cradle segments 115A-115I together end-to-end. In an alternate embodiment generally similar to that of the embodiment shown in FIGS. 2A through 2D, the various segments 115A-115I can define a line of weakness (not shown) between them, thereby defining frangible portions that can be snapped off to approximate a desired length. Referring with particularity to FIG. 4C, details of the connection of cradle 115 to shelf 2 via clips 125, where the variant with numerous segments 115A-115I, are shown. A combination of snap-fit connections 125A, 125B, the first to the longitudinal members 2A and second to the crossbar members 2B of shelf 2, ensure secure coupling between them. It will of course be appreciated that the segmented variant is shown for convenience, and that the variant employing frangible portions of cradle 115 could be incorporated similarly. As with the previous embodiment shown in FIGS. 2A through 2D, slots 117 formed in cradle 115 allow for the flow of refrigerated air from display case 1 through display track 110 to improve the cooling of first and second containers 3A, 3B. Referring with particularity to FIG. 4E, cradle 115 is used for accepting a first container 3A, and includes a facade 130 to allow attachment of advertisements, product prices or related indicia. As mentioned above, second clip portion 125B of clip 125 can be used to form a snap-fit connection with the crossbar member 2B of shelf 2, although it may also form a simple hanger member in order to avoid having to have it sized for such a snap-fit connection. Referring with particularity to FIG. 4F, a single-piece molded clip 225 can be formed, being a more simplistic variant on clip 125 of FIG. 4E, in this case not including the second clip portion. As with the clip portion 125A, clip portion 225A is sized and shaped to form a resilient snap-fit connection with the longitudinal members 2A.

The placement of display track 110 is such that visual and physical access to second containers 3B placed on shelf 2 is not appreciably hampered. The arcuate nature of a connecting portion of clip 125 can be appreciated by reference to its cooperation with crossbar member 2B, as shown with particularity in FIGS. 4C and 4E. In addition, the segment 115I of cradle 115 includes projecting dowels 122 and inserts 123 that can be used to fit into a corresponding aperture (not presently shown) of adjoining cradle segment 115H (as shown in FIG. 4B). FIG. 4D shows the front elevation view of the display track 10 coupled to the shelf 2 of FIG. 4C, while FIG. 4E shows a side elevation view, where a slot 120A in cradle 115 is sized to permit the insertion of the front of clip 125 such that the two are secured to one another. The arcuate connector of clip 125 is resilient enough to promote a snap-fit over crossbar member 2B of shelf 2, while detents 130A, 130B on facade 130 are sized to accept a placard (not shown). It will be appreciated by those skilled in the art that clip 125 is preferably made from a resilient material (for example, a creep-resistant plastic) to permit such a snap-fit connection.

Figure 5:
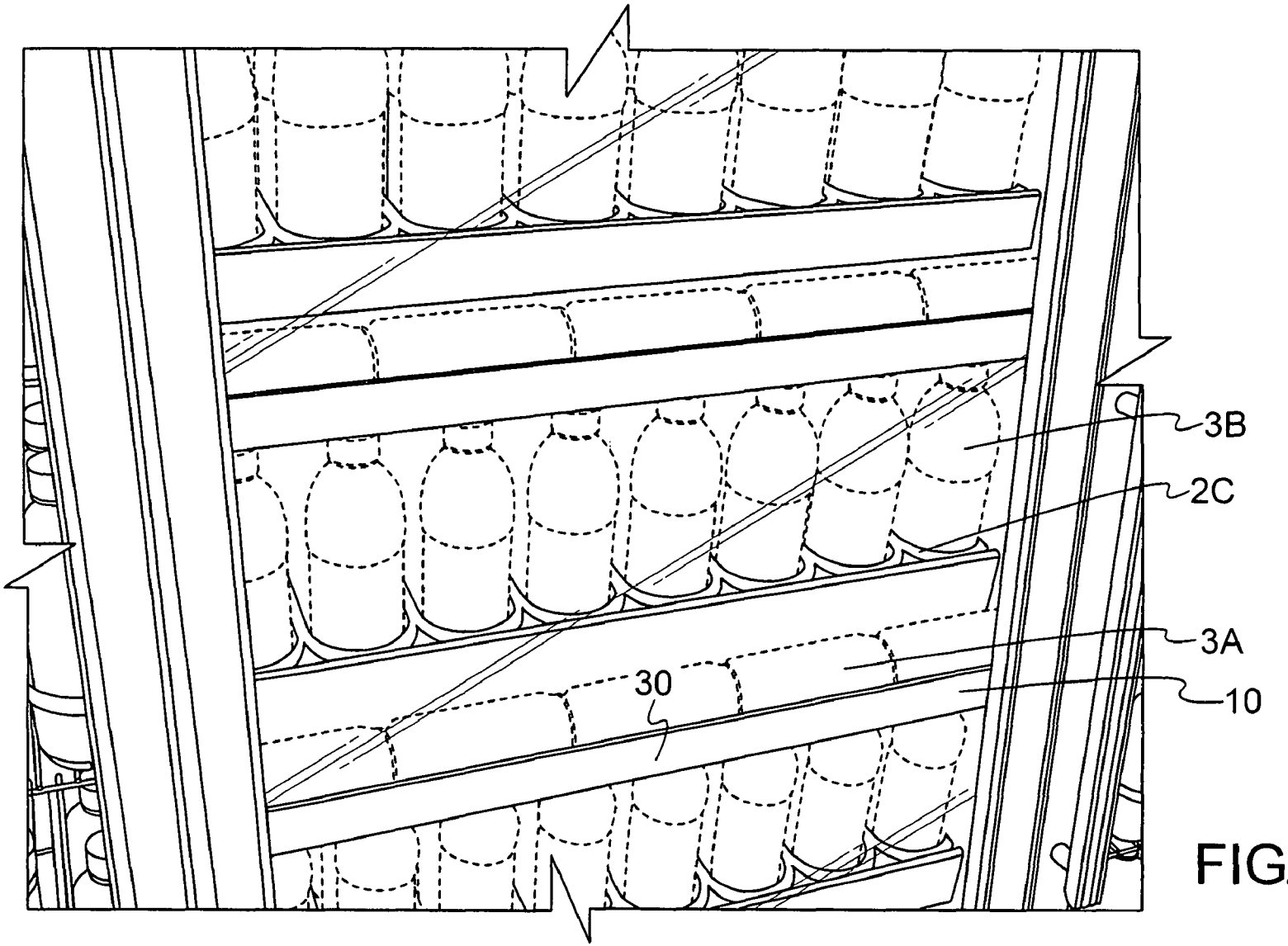
FIG. 5 is a close-up view of the display track of FIG. 2A, as seen through the door of the display case.

Referring next to FIG. 5, placement of display track 10 according to the embodiment of the invention depicted in FIGS. 2A through 2D into a display case 1 is shown, where first containers 3A situated horizontally therein offer prominent display of the product without obscuring the view of second containers 3B placed on conventional shelf 2. Similarly, the facade 30 allows attachment of advertisements, product prices or related indicia without obscuring similar labeling of the second containers 3B. By being secured directly to the shelf (not presently shown) rather than to the door (such as by suction cups), the display track 10 avoids the need to have the first containers 3A move when the door is opened, thus minimizing the likelihood of dropping and possible rupture of the container. It will be appreciated by those skilled in the art that while use of the display track 10 is shown with particularity for beverage containers, that it could be adapted for use with other products and their containers, and that such adaptation would be within the scope of the present invention. Examples of other uses include for containers for yogurt, chip dip or salsa, candy bars, cheese, cookie dough or the like.

Figure 6A:
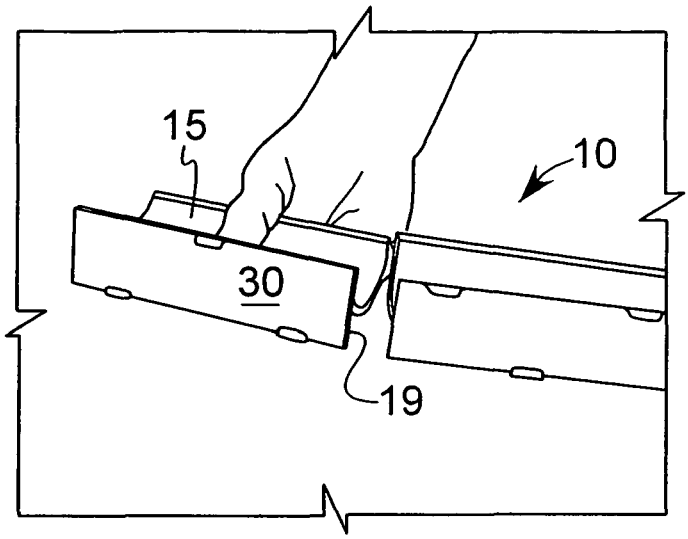
FIGS. 6A through 6I show steps involved in the attachment of the display track of FIGS. 2A through 2D to a shelf.
Figure 6B:
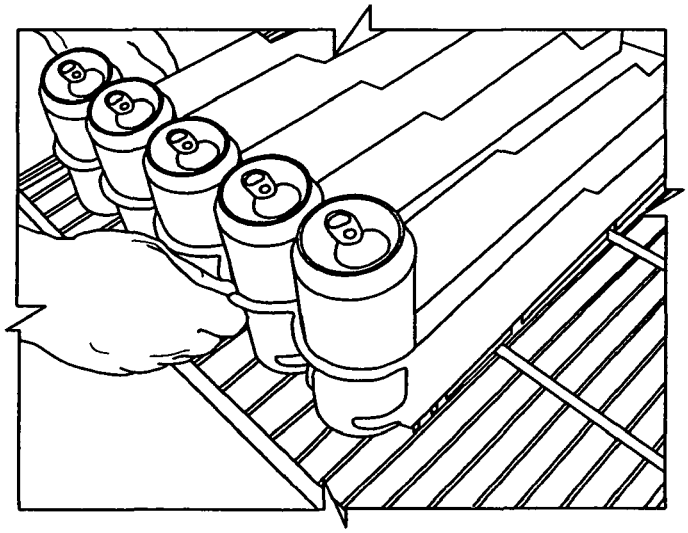
Figure 6C:
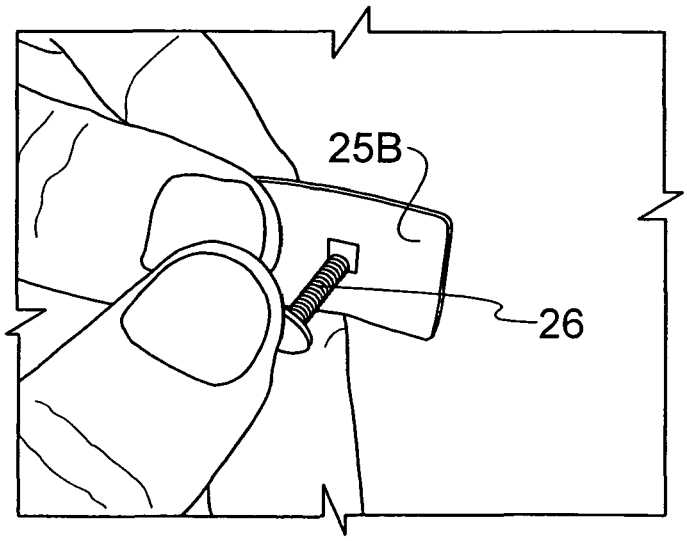
Figure 6D:
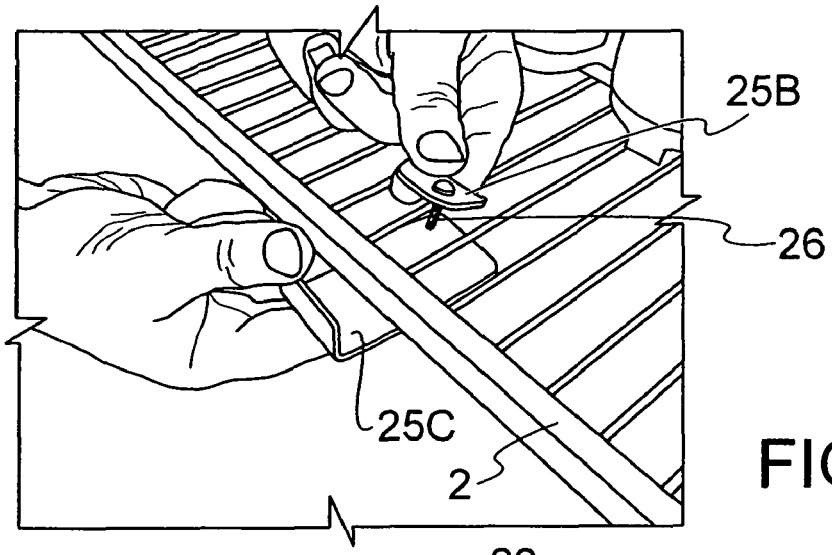
Figure 6E:
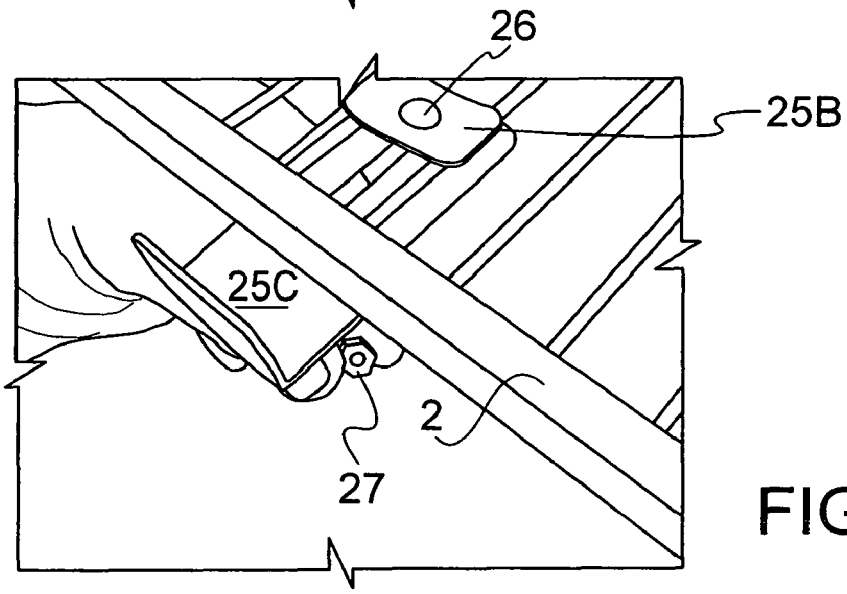
Figure 6F:
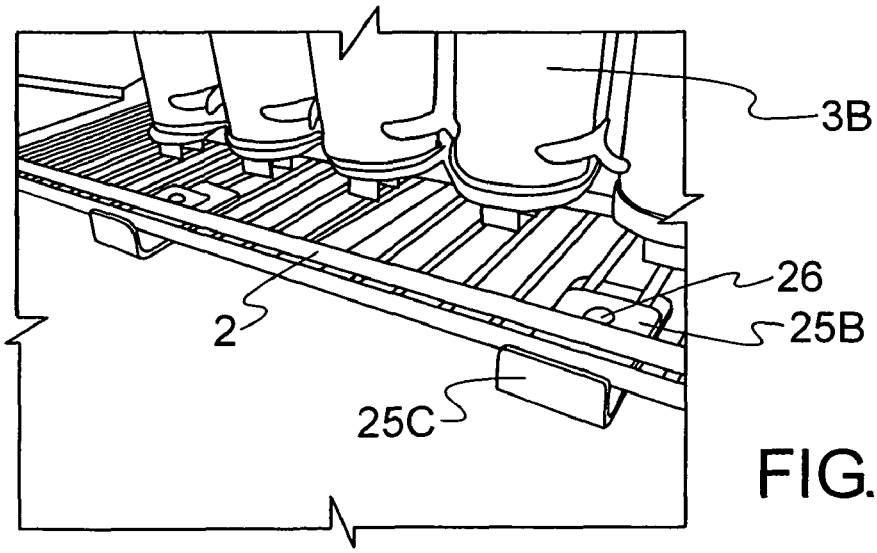
Figure 6G:
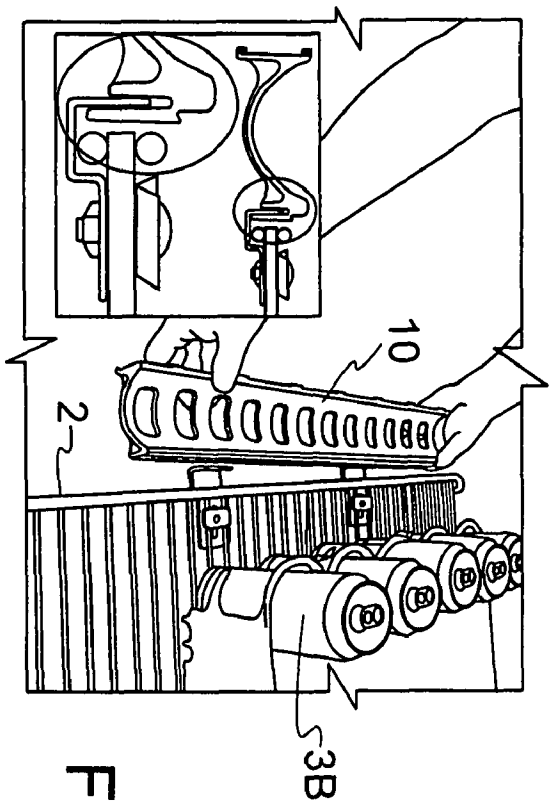
Figure 6H:
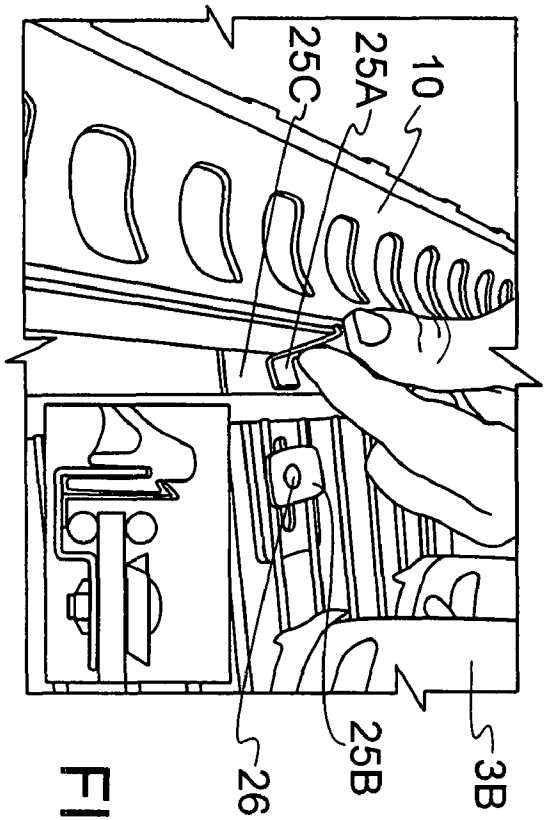
Figure 6I:
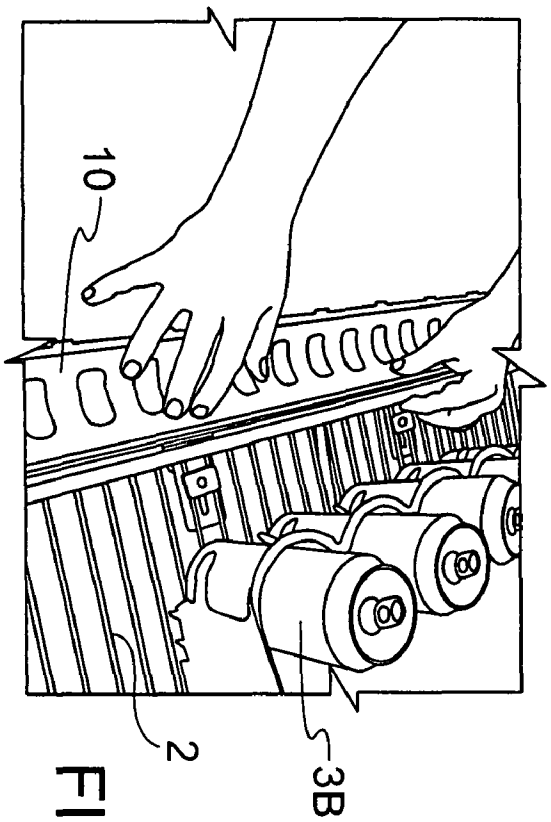

Referring next to FIGS. 6A through 6I, steps involved in the connection of are shown. In a first step, the installer determines the width of the display shelf 2. If the width of shelf 2 is greater than the longitudinal dimension of the display track 10 (which, in a preferred, although not necessary, embodiment is 26¼"), the entire length can be used. If the width of shelf 2 is not as great as the entirety of the longitudinal dimension of the display track 10, but is longer than the length of the display track 10 at its endmost line of weakness 19 (for example, between 26¼" and 16"), the installer can break off a portion of the display track 10 that extends beyond the line of weakness 19, as shown in FIG. 6A. In one embodiment, the frangible portions that correspond to the various lines of weakness 19 are approximately six inches in length. If the width of shelf 2 is less than the length of the display track 10 at its endmost line of weakness 19, a second frangible section can be broken off along the next line of weakness 19. It will be appreciated that while the labels identifying the products are shown having already been placed on facade 30 prior to installation of the display track 10, such placards, labels or related signage could be mounted at any time during the installation process. Referring with particularity top FIG. 6B, once the installer removes existing second container 3B from the shelf or pushes back a product glide unit 2*d* (to which retainers 2*c* are attached) to expose the shelf longitudinal and crossbar members 2A, 2B. Referring next to FIG. 6C, the installer slides the bolt 26 through a hole in the top of the V-shaped top clip 25B, then as shown in FIG. 6D, place the two with the apex of the V-shape pointing downward between adjacent longitudinal members 2B so that the position of the V-shaped top clip 25B will not obstruct the product glide unit 2D, and inserting the bolt 26 through a slot-shaped aperture formed in bottom clip 25C. Next, as shown in FIG. 6E, while holding the assembly of top clip 25B, bottom clip 25C and bolt 26 firmly, the installer places a lock nut 27 on the threaded (downward end) of bolt 26 and tightens the lock nut 27 to a mostly (but not completely) tight position. In so doing, there is enough slack in the assembly to allow it to be slid back and forth along the longitudinal members 2B but still secured to keep top clip 25B, bottom clip 25C, bolt 26 and lock nut 27 together as an assembly. FIG. 6F shows the installation of a second clip 25 in a manner similar to that of the first clip 25 shown in FIGS. 6A through 6E. As shown in FIG. 6G, display track 10 can now be secured to the clips 25 by aligning the slot-shaped cutout segment 20A of shelf-engaging portion 20 with the upstanding portion of bottom clip 25C. As shown in FIG. 6H, the installer wedges lock clip 25A between the shelf-engaging portion 20, the bottom clip 25C and a crossbar member 2B of shelf 2. Lock clip 25A must be installed correctly to ensure a secure connection and to make sure that the display track 10 does not fall once installed. As shown in FIG. 6I, once the clip 25 (including lock clip 25A) is installed, the installer holds each end of the display track 10 and pushes firmly against the shelf 2. Lastly, the installer tightens the lock nut 27 the remainder of the way so that nothing is loose. At this time, the display track 10 is ready to be loaded with product.

While certain representative embodiments and details have been shown for purposes of illustrating the invention, it will be apparent to those skilled in the art that various changes may be made without departing from the scope of the invention, which is defined in the appended claims.

What is claimed is:

1. A beverage track for a product display case, said beverage track attachable to a shelf in said display case and comprising:

a shelf-engaging portion defining a substantially rigid structure; and a product cradle portion rigidly coupled to said shelf-engaging portion, said product cradle portion defining a beverage container trough such that at least one beverage container placed therein is displayed in a substantially horizontal orientation within said container trough in order that such at least one beverage container does not substantially obscure a product placed on said shelf, said cradle portion comprising at least one line of weakness therein to define a corresponding frangible portion of said container trough thereby, wherein a segment of said cradle portion can be broken off along said at least one line of weakness without use of a tool.

2. The beverage track of claim 1, further comprising a label-mounting portion disposed on a forward-facing surface of said product cradle portion.

3. The beverage track of claim 2, wherein said label-mounting portion comprises a plurality of inwardly-pointing detents disposed on opposing ends of said forward-facing surface such that a sheet configured to bear printed indicia thereon could be placed therebetween.

4. The beverage track of claim 2, wherein said shelf-engaging portion, label-mounting portion and product cradle portion make up a unitary structure to define a one-piece construction.

5. The beverage track of claim 1, wherein said product cradle portion defines a substantially elongate direction along said beverage track.

6. The beverage track of claim 5, wherein said at least one line of weakness is formed across said substantially elongate direction.

7. The beverage track of claim 6, wherein said frangible portion formed by said at least one line of weakness is approximately six inches in length.

8. The beverage track of claim 1, wherein said beverage track, when attached to the shelf, is situated substantially forward thereof.

9. The beverage track of claim 1, wherein said beverage container trough defines a substantially horizontal arcuate profile.

10. The beverage track of claim 1, further comprising a clip configured to secure said shelf-engaging portion to said shelf.

11. The beverage track of claim 10, wherein said clip comprises a plurality of components held together by a fastener.

12. The beverage track of claim 10, wherein said clip comprises at least one snap-fit connection configured to engage a corresponding member on said shelf.

13. The beverage track of claim 10, wherein said clip is integrally formed with said product cradle portion.

14. The beverage track of claim 1, wherein said product cradle portion defines therein arcuate regions of differing dimensions.

15. The beverage track of claim 1, wherein the beverage track is made from a plastic material.

16. A shelf for display case, said shelf comprising:

a substantially tray-like structure configured to hold a plurality of product containers in a substantially upright orientation; and a beverage track configured to hold a plurality of beverage containers forward of said substantially tray-like structure such that a beverage container placed in said beverage track is displayed in a substantially horizontal orientation in order that it does not substantially obscure the product containers placed on said substantially tray-like structure, said beverage track comprising at least one line of weakness therein to define a corresponding frangible portion to enable selective shortening of said beverage track along its elongate direction, wherein a segment of said beverage track can be broken off along said at least one line of weakness without use of a tool.

17. The shelf of claim 16, wherein said beverage track is attached to said tray-like structure with a clip.

18. The shelf of claim 16, wherein said beverage track is integrally formed with said tray-like structure.

19. The shelf of claim 16, wherein said beverage track includes a clip that is configured to connect said beverage track to said tray-like structure.

20. A beverage track for a product display case, said beverage track attachable to a shelf in said display case and comprising:

a shelf-engaging portion defining a substantially rigid structure; and a product cradle portion rigidly coupled to said shelf-engaging portion, said product cradle portion defining a beverage container trough such that at least one beverage container placed therein is displayed in a substantially horizontal orientation within said container trough in order that such at least one beverage container does not substantially obscure a product placed on said shelf, said cradle portion comprising at least one line of weakness therein to define a corresponding frangible portion of said container trough thereby, wherein slots are formed in said cradle portion to allow refrigerated air to flow through said beverage track to enable improved cooling of said at least one beverage container displayed therein.

* * * * *